US011777240B2

(12) United States Patent
Chen

(10) Patent No.: US 11,777,240 B2
(45) Date of Patent: Oct. 3, 2023

(54) CONNECTOR ASSEMBLY DIRECTLY CONNECTED TO A FLAT CABLE

(71) Applicant: Ying Hao Technology Co., LTD., New Taipei (TW)

(72) Inventor: Chih-Jung Chen, New Taipei (TW)

(73) Assignee: Ying Hao Technology Co., LTD., New Taipei (TW)

( * ) Notice: Subject to any disclaimer, the term of this patent is extended or adjusted under 35 U.S.C. 154(b) by 203 days.

(21) Appl. No.: 17/495,870

(22) Filed: Oct. 7, 2021

(65) Prior Publication Data

US 2022/0109259 A1 Apr. 7, 2022

(30) Foreign Application Priority Data

Oct. 7, 2020 (TW) ..... 109213172

(51) Int. Cl.
*H01R 12/77* (2011.01)
*H01R 12/79* (2011.01)

(52) U.S. Cl.
CPC ..... *H01R 12/771* (2013.01); *H01R 12/79* (2013.01)

(58) Field of Classification Search
CPC .. H01R 12/771; H01R 12/79; H01R 12/7011; H01R 13/6586; H01R 13/405; H01R 12/592
See application file for complete search history.

(56) References Cited

U.S. PATENT DOCUMENTS 10,897,098 B2 1/2021 Suda et al.
2009/0298327 A1* 12/2009 Wang ..... H01R 12/62 439/507
2019/0199021 A1* 6/2019 Vittapalli ..... H01R 12/65

FOREIGN PATENT DOCUMENTS

CN 111162396 A * 5/2020 ..... H01R 12/61
JP 2020072035 A 5/2020
TW M447603 U 2/2013
TW M475080 U 3/2014

OTHER PUBLICATIONS

Machine Translation CN 111162396, (May 15, 2020) (Year: 2023).*

* cited by examiner

*Primary Examiner* — Travis S Chambers
(74) *Attorney, Agent, or Firm* — Mark M. Friedman

(57) ABSTRACT

A connector assembly includes a connector and a flat cable. The connector includes a first terminal, a second terminal, a first body, a second body, a metal plate, a third body, and a shell. The first and second terminals electrically connect a first side and a second side of the flat cable respectively and are respectively contained in a first capacity slot and a first through-hole of the first body and in a second capacity slot and a second through-hole of the second body. The first and second bodies clamp the metal plate. The third body partly winds and fixes the first body and the second body, and protects a terminal conductive contact part of the flat cable connected by the first and second terminals to form the connector. The flat cable connects to the connector directly. There is no need for a fixed rigid printed circuit board.

33 Claims, 12 Drawing Sheets

2

CONNECTOR ASSEMBLY DIRECTLY CONNECTED TO A FLAT CABLE

CROSS REFERENCE

This application claims the priority of Taiwanese Patent Application No. 109213172, entitled "CONNECTOR ASSEMBLY", filed on Oct. 7, 2020, disclosure of which is incorporated herein by reference in its entirety.

FIELD OF THE INVENTION

The present disclosure relates to a connector assembly, and more particularly to a connector assembly with flat cables directly electrically connecting to its connector, rigid printed circuit board without fixing, simple assembly, and simplified manufacturing process.

BACKGROUND

With the rapid development of preservation technology, the size of connector continues to shrink and the need to better increase the capacity of data transmission is required. The flat cable is a data conductor flat cable, which is configured to transmit data between two electronic devices. Flex flat cable (FFC) or flexible printed circuit flat cable is both new types of data flat cable, which is made of insulating materials and extremely thin tinned flat copper wires pressed by automatic equipment, or uses the substrate that has been coated with copper with etching method to produce single-sided, double-sided, multi-layer flexible printed circuit board flat cable. Due to its neatly arranged cores, large transmission capacity, flat structure, small size, and flexibility, it can be flexibly applied to all kinds of electronic products as a data conductor cable. The flexible flat cable and the flexible printed circuit board flat cable are especially suitable for conditions of all kinds of high-frequency transmission and where the flat cable needs to be bent and assembled. In connecting, the flexible printed circuit board is welded on a rigid printed circuit board of a fixed connector, and then connected to the connector via the rigid printed circuit board. In this way, the connector transmits the signal of the flexible flat cable to other electronic devices.

In prior art, the flat cable is welded to the rigid printed circuit board of the connector first, then the connector is set on a rigid printed circuit board. Accordingly, the rigid printed circuit board occupies a certain space, and in the meantime, one more rigid printed circuit board for fixing the connector is needed. In addition, more importantly, once the high-frequency transmission of the signal passes by one more medium (the flat cable→the rigid printed circuit board→the connector), the depletion and decay of the signal are certainly inevitably increased.

SUMMARY

According to the above statement, it is necessary to provide a connector assembly to solve the problem of the prior art.

One objective of a first embodiment of the present disclosure is to provide a connector assembly, which includes a connector and a flat cable. The flat cable includes a first side, a second side, a third side, and a flat cable turning part. The first side includes a plurality of first side electrical contacts. The second side includes a plurality of second side electrical contacts. The third side includes a plurality of third side electrical contacts. The first side electrical contacts and the second side electrical contacts are electrically connected to the third side electrical contacts. The connector includes: a first terminal including a plurality of first terminal conductive contact parts and a plurality of first terminal contact parts, the first terminal conductive contact parts are connected to the first side electrical contacts; a second terminal including a plurality of second terminal conductive contact parts and a plurality of second terminal contact parts, the second terminal conductive contact parts are connected to the second side electrical contacts; a first body including a first surface, a second surface, a plurality of first capacity slots and a plurality of first through-holes, wherein the first capacity slots are located on the first surface, the first terminal contact parts are respectively contained in the first capacity slots; a second body including a third surface, a fourth surface, a plurality of second capacity slots and a plurality of second through-holes, wherein the second capacity slots are located on the third surface, the second terminal contact part are respectively contained in the second capacity slots; a metal plate folding the flat cable in half with the flat cable turning part, the second surface of the first body and the fourth surface of the second body are opposite, making the metal plate be clamped between the first body and the second body; and a third body, partly winding and fixing the first body and the second body, exposing the first terminal contact parts and the second terminal contact parts.

One objective of a second embodiment of the present disclosure is to provide a connector assembly including a connector and two flat cables. Each of the two flat cables includes a first side a second side, the first side having a plurality of first side electrical contacts, the second side having a plurality of second side electrical contacts; the connector includes: a first terminal, including a plurality of first terminal conductive contact parts and a plurality of first terminal contact parts, the first terminal conductive contact parts are connected to the first side electrical contacts; a second terminal, including a plurality of second terminal conductive contact parts and a plurality of second terminal contact parts, the second terminal conductive contact parts are connected to the second side electrical contacts; a first body, including a first surface, a second surface, a plurality of first capacity slots and a plurality of first through-holes, wherein the first capacity slots are located on the first surface, the first terminal contact parts are respectively contained in the first capacity slot; a second body, including a third surface, a fourth surface, a plurality of second capacity slots and a plurality of second through-holes, wherein the second capacity slots are located on the third surface, the second terminal contact parts are respectively contained in the second capacity slots; a metal plate, the second surface of the first body and the fourth surface of the second body are opposite, making the metal plate be clamped between the first body and the second body; and a third body, partly winding and fixing the first body and the second body, exposing the first terminal contact parts and the second terminal contact parts.

According to one embodiment of the present disclosure, the connector further includes a shell, cladding the first body, the second body, the third body, and the first side and the second side of the flat cable.

According to one embodiment of the present disclosure, the first body further includes a first front section and a first rear section, the first capacity slots are located on the first surface of the first front section, the first through-holes are located on the second surface of the first rear section, the first terminal respectively passing through the first through-holes.

According to one embodiment of the present disclosure, the second body further includes a second front section and a second rear section, the second capacity slots are located on the third surface of the second front section, the second through-holes are located on the fourth surface of the second rear section, the second terminals pass through the second through-holes, respectively.

According to one embodiment of the present disclosure, the first body further includes a first positioning-hole and at least one first positioning column locating on the second surface; the second body further includes at least one second positioning-hole and at least one second positioning column locating on the fourth surface; wherein the first positioning-hole can accommodate the second positioning column, the second positioning-hole can accommodate the first positioning column.

According to one embodiment of the present disclosure, the first body further includes at least one first fixing slot way locating on the first surface, the third body further includes at least one fixing slot buckle strip, the fixing slot buckle strip are buckled in the first fixing slot way.

According to one embodiment of the present disclosure, the second body further includes at least one second fixing slot way locating on the third surface, the third body further includes at least one fixing slot buckle strip, the fixing slot buckle strip are buckled in the second fixing slot way.

According to one embodiment of the present disclosure, the first body further includes a first front section, the second body further includes a second front section, the first front section further includes a first section fixing fastener, the second front section further includes a front section fixing buckle slot, the first section fixing fastener and the front section fixing buckle slot interlocked.

According to one embodiment of the present disclosure, the first body further includes a rear section embedding piece locating on both sides of the first rear section, configured to embed the third body, the first body further includes a rear section snapping piece locating on both sides of the first rear section, configured to snap the second body.

According to one embodiment of the present disclosure, the third body further includes a front section fixing clasp, configured to clasp the first body, the third body further includes a first section fixing fastener, configured to fasten the first body.

According to one embodiment of the present disclosure, the metal plate further includes a positioning through-hole, configured to let the first positioning column and the second positioning column pass through.

According to one embodiment of the present disclosure, the first body and the second body are respectively formed with injection molding, configured to respectively cladding the first terminal and the second terminal.

According to one embodiment of the present disclosure, the third body and formed with injection molding, configured to partly cladding and clamping the first body and the second body of the metal plate.

Compared with the existing connector, the connector terminal of the connector assembly of the present disclosure is directly connected to the flat cable. There is no need for one more rigid printed circuit board to fix the connector. The assembly is simple and the manufacturing process is simplified, so the assembly steps can be simplified and the material cost can be reduced. Moreover, because of the reduction of a passing medium the high-frequency transmission of signal needs to pass through (the flat cable→the connector), the depletion and decay of the high-frequency signal are avoidable.

To make the above-mentioned content of this disclosure easier to understand, the following is a detailed description of preferred embodiments in conjunction with the accompanying drawings.

The realization of the purpose of the present embodiments, the functional characteristics, and advantages will be further explained in conjunction with the embodiments and with reference to the accompanying drawings.

DETAILED DESCRIPTION OF PREFERRED EMBODIMENTS

Specifically, the terminologies in the embodiments of the present disclosure are merely for describing the purpose of the certain embodiment, but not to limit the invention. Examples and the appended claims be implemented in the present disclosure requires the use of the singular form of the book "a", "an" and "the" are intended to include most forms unless the context clearly dictates otherwise. It should also be understood that the terminology used herein that "and/or" means and includes any or all possible combinations of one or more of the associated listed items.

Figure 1:
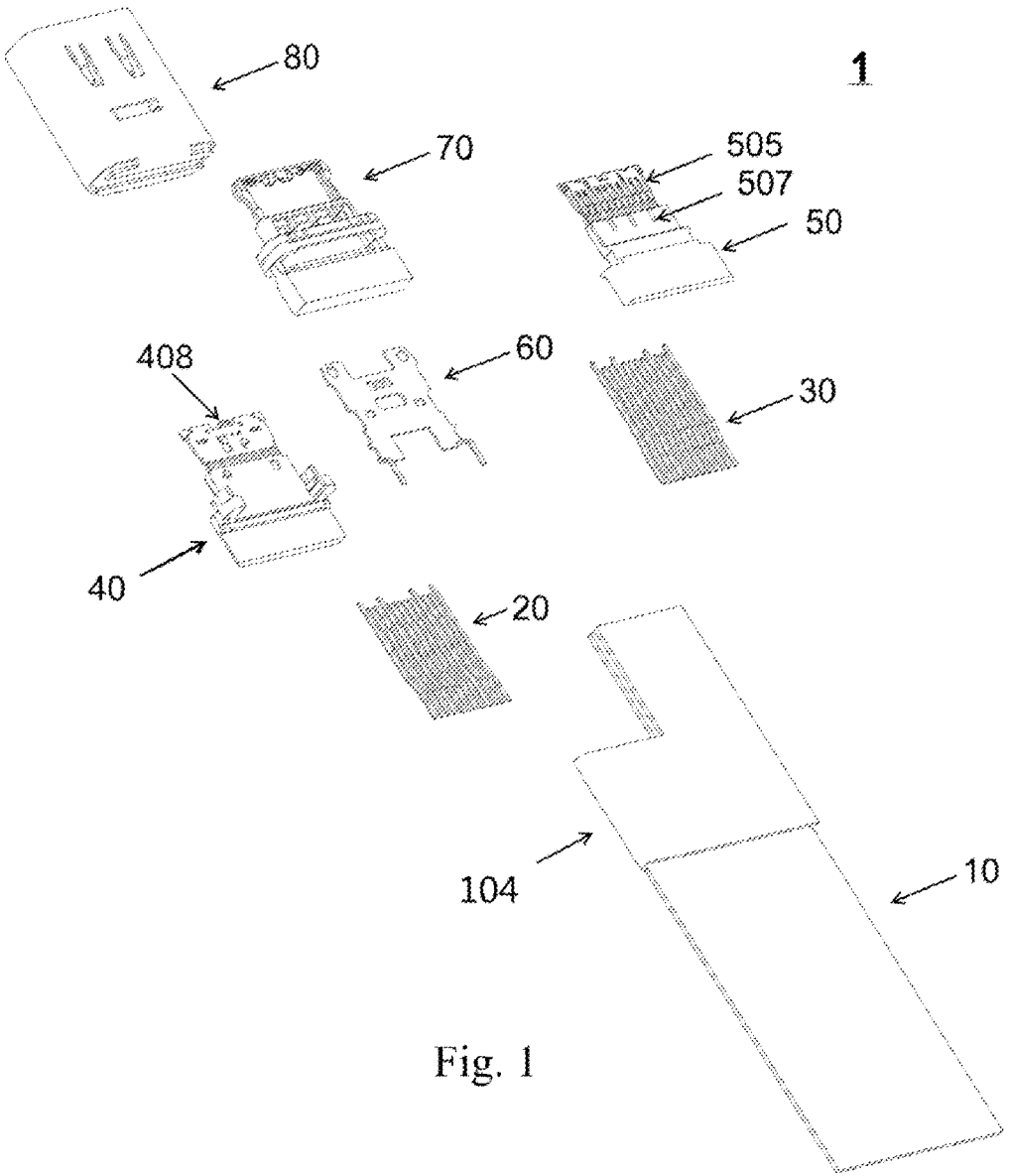
FIG. 1 is a top view of an exploded diagram of a connector assembly according to a first embodiment of the present disclosure.
Figure 2:
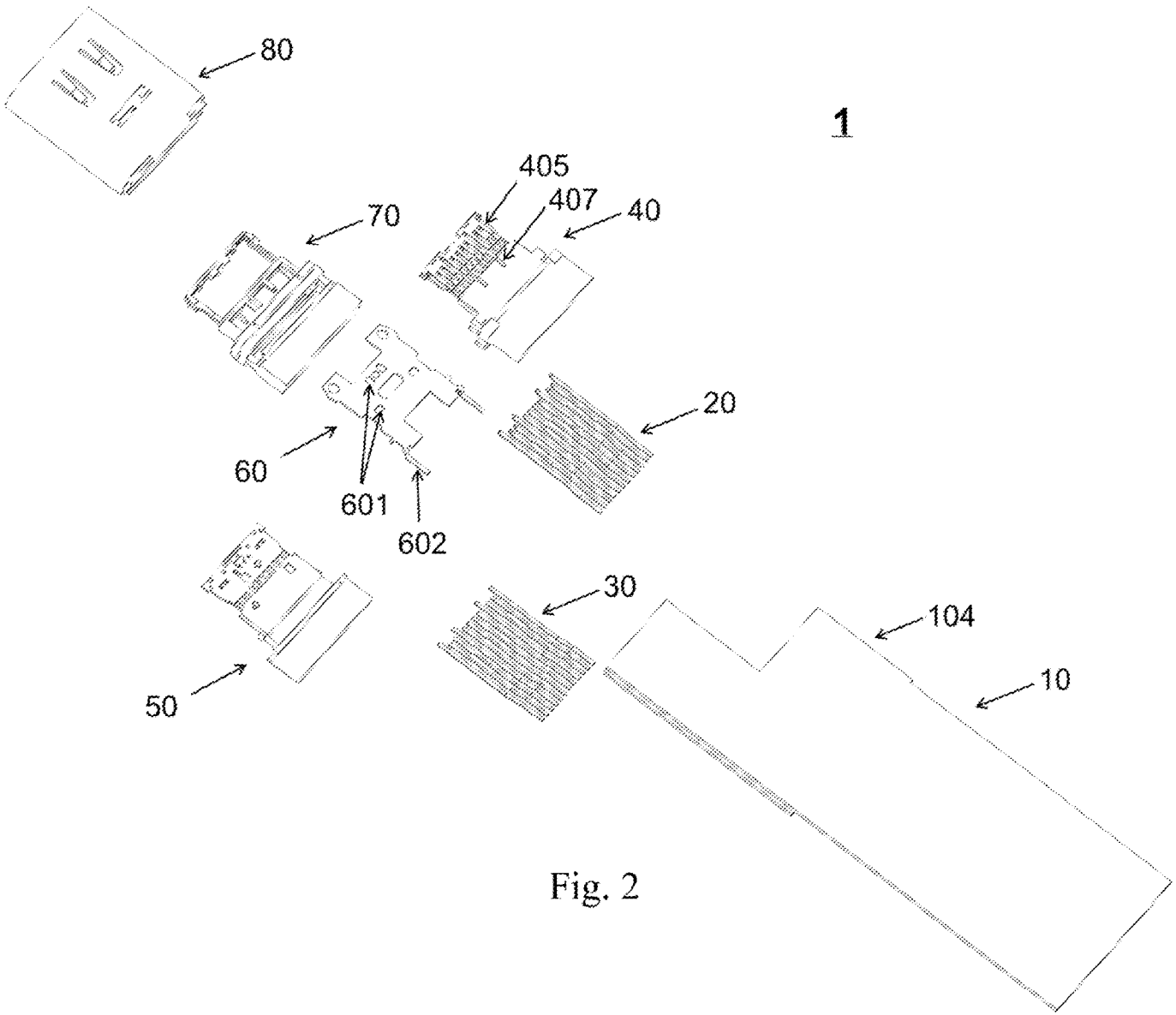
FIG. 2 is a bottom view of an exploded diagram of a connector assembly according to the first embodiment of the present disclosure.
Figure 3:
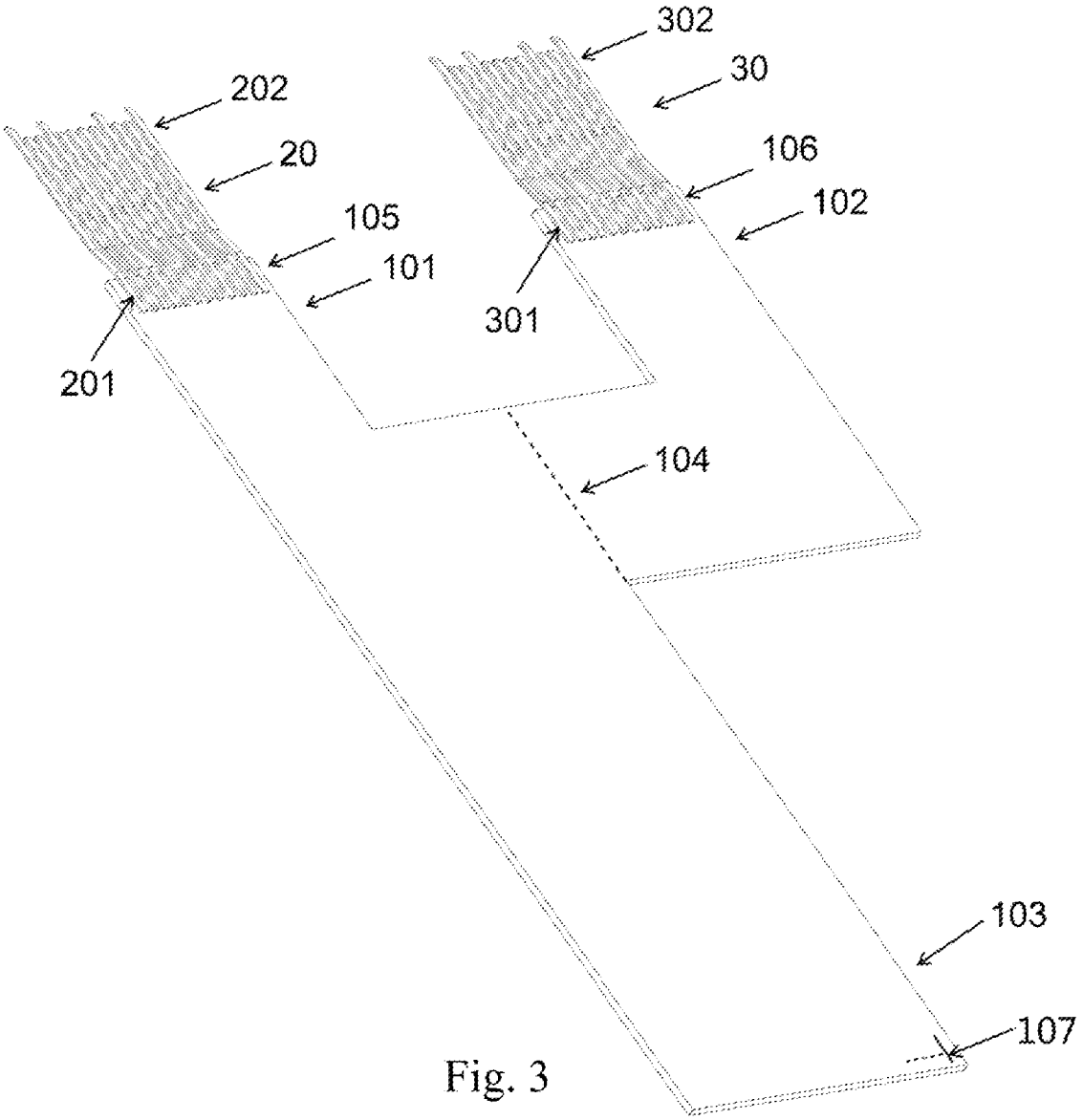
FIG. 3 is a top view schematic diagram depicting that a first terminal and a second terminal welded on a flat cable.
Figure 4A:
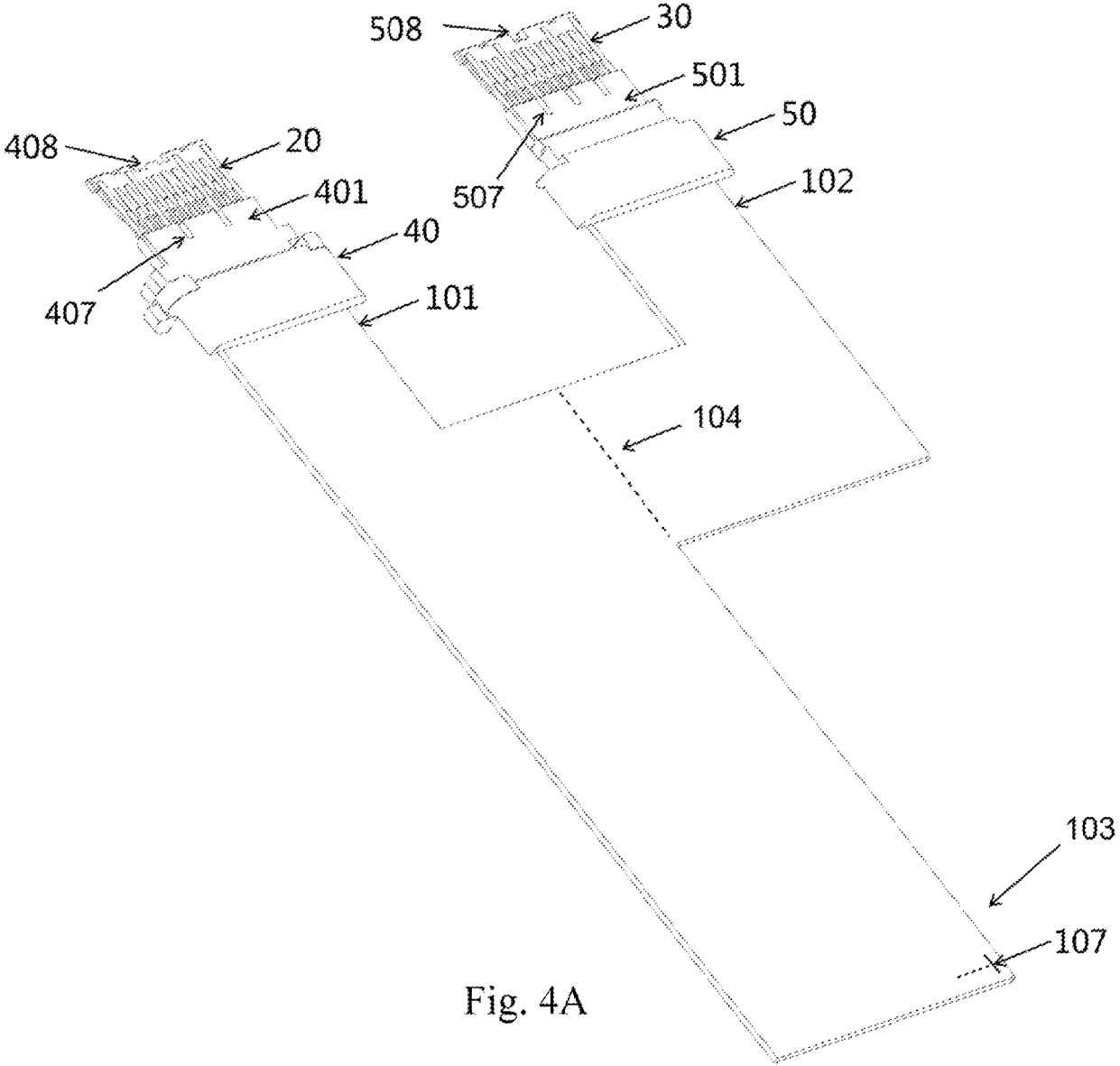
FIG. 4A is a schematic diagram depicting that a first body and a second body cladding a first terminal and a second terminal.
Figure 4B:
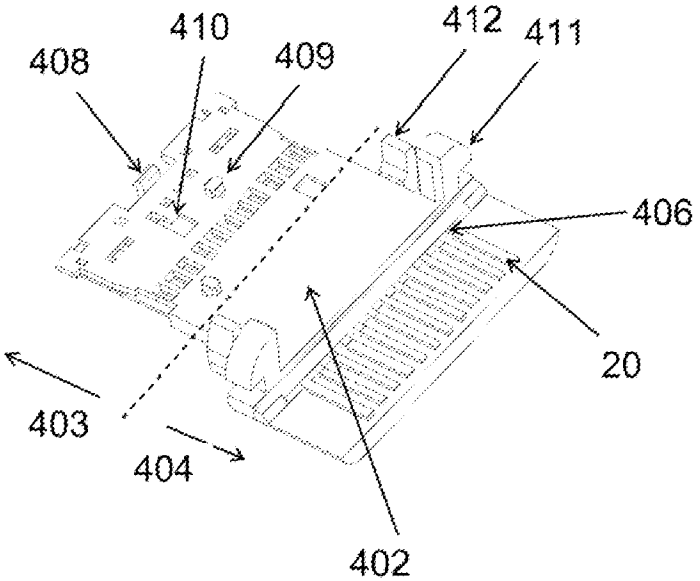
FIG. 4B is a schematic diagram depicting a second surface of a first body and a fourth surface of a second body.
Figure 4B:
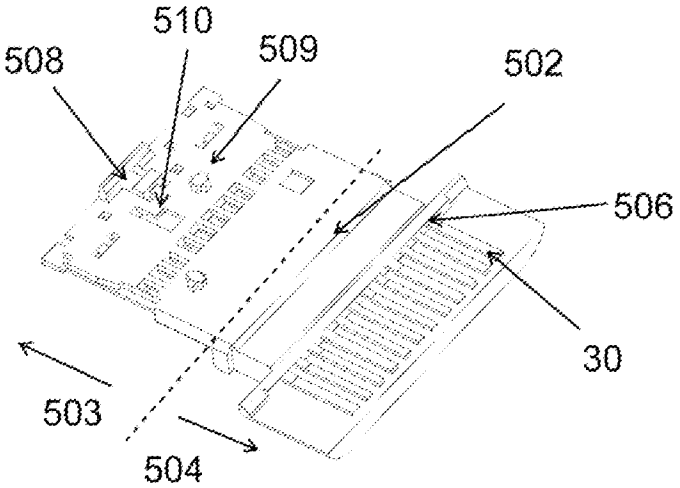
Figure 5:
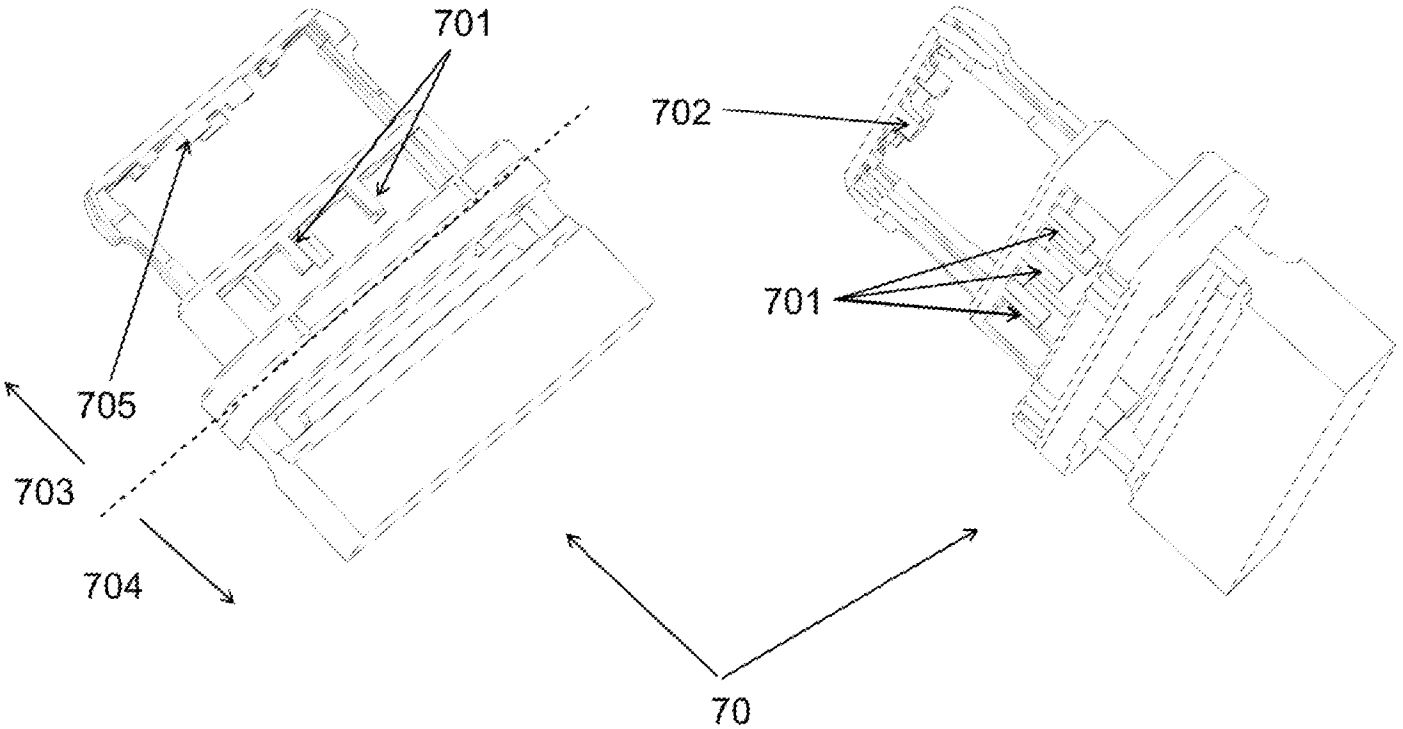
FIG. 5 is a three-dimensional schematic diagram of the two sides of a third body.
Figure 6:
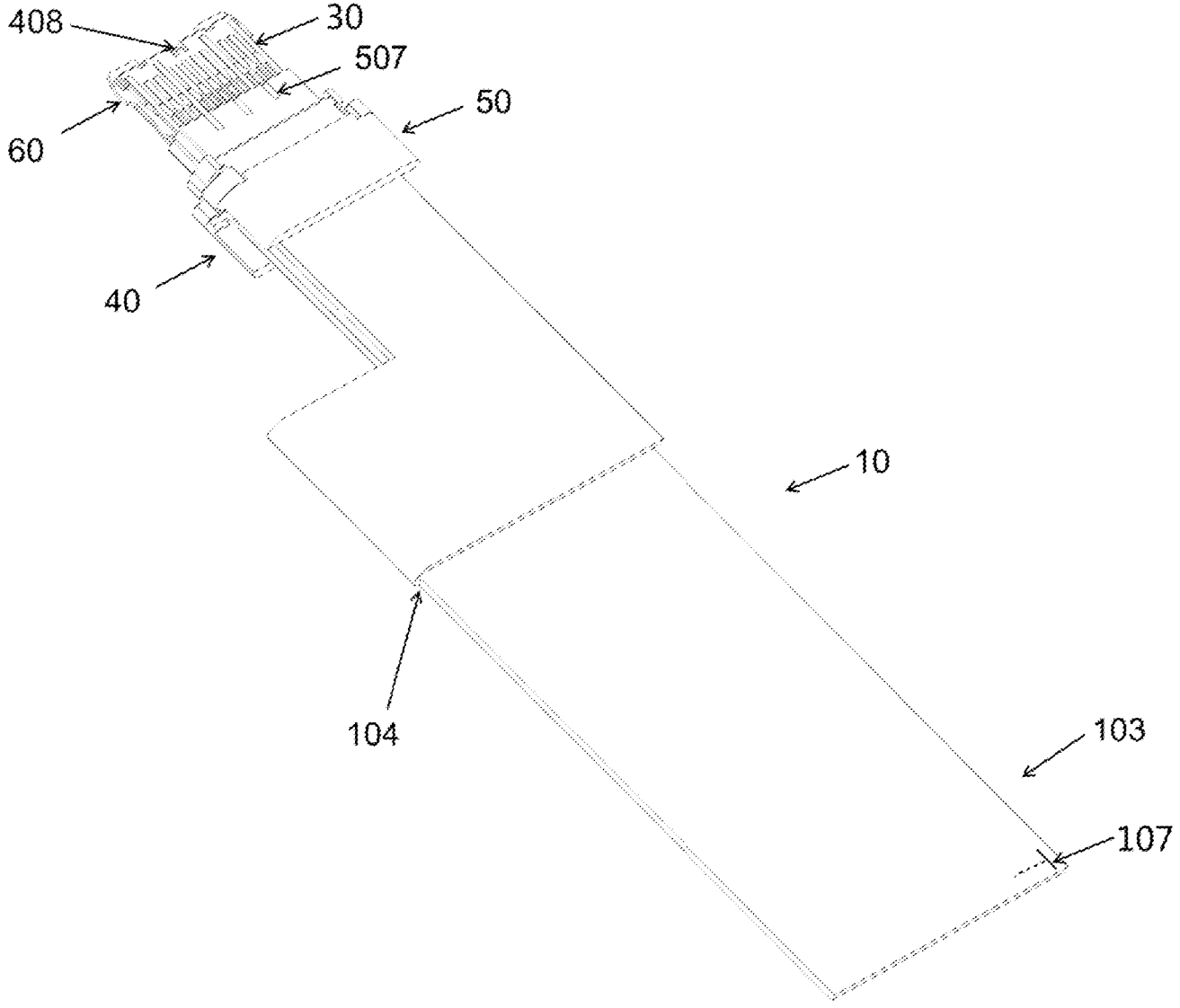
FIG. 6 is a three-dimensional schematic diagram depicting that a first body, a second body, and a flat cable after folding the flat cable in half with a flat cable folded part.
Figure 7:
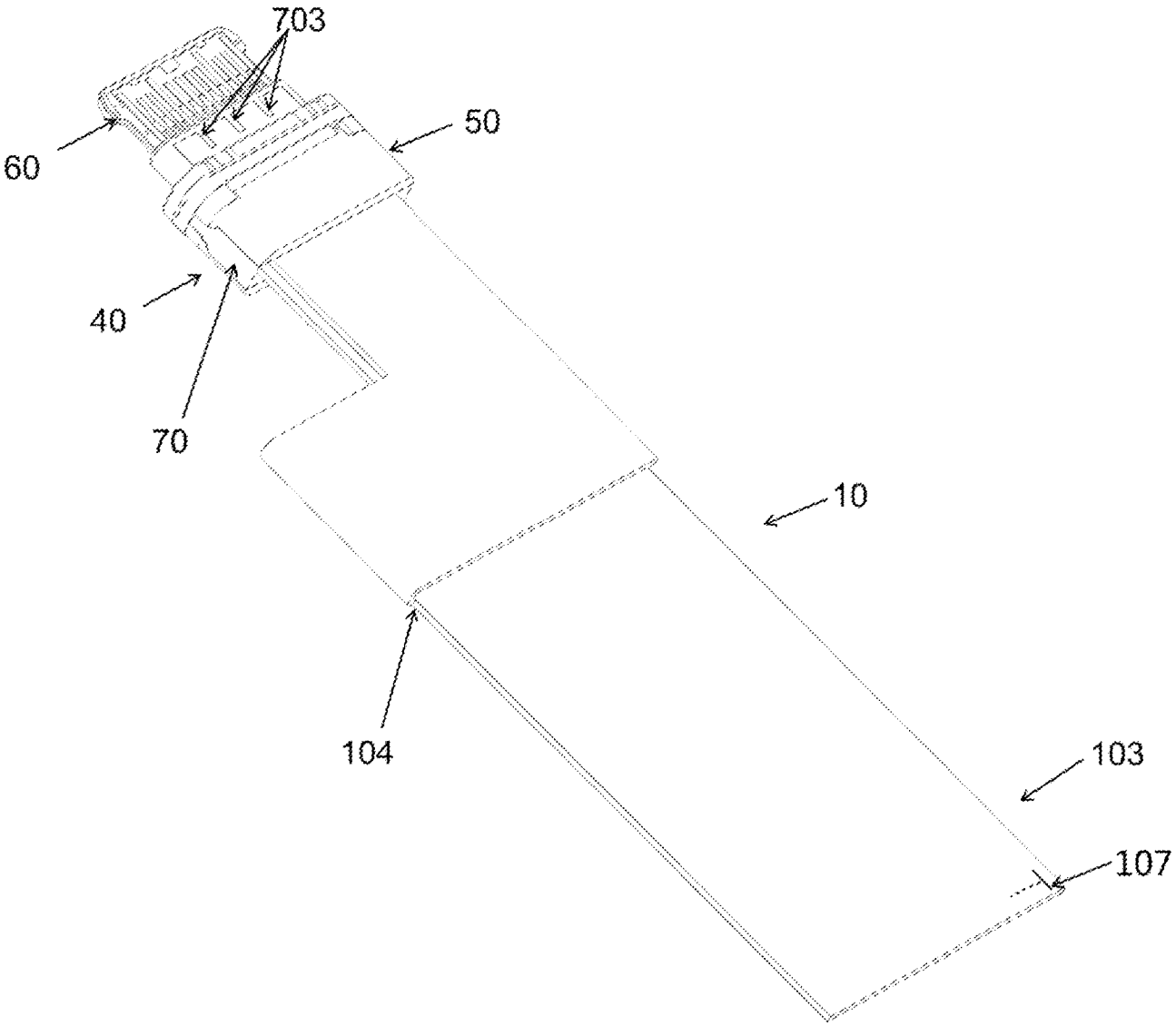
FIG. 7 is a three-dimensional schematic diagram depicting that a third body cladding a first body, a second body, and a flat cable.
Figure 8:
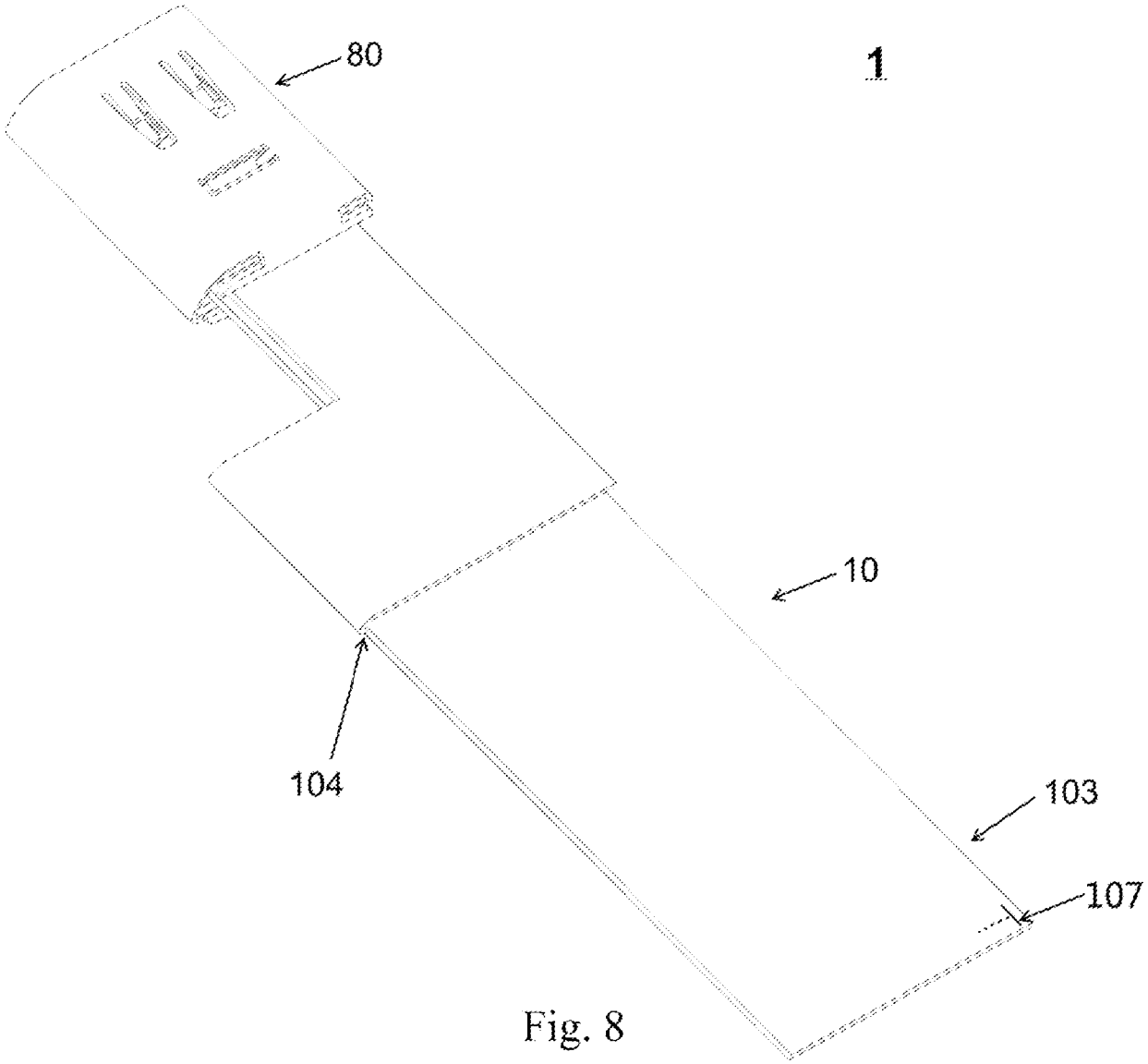
FIG. 8 is a three-dimensional schematic diagram depicting a connector assembly of the first embodiment after a shell cladding a first body, a second body, a third body, and a flat cable.

Please refer to a first embodiment relating to a connector assembly of the present disclosure in FIGS. 1-8. FIG. 1 is an exploded diagram of the connector assembly according to the first embodiment of the present disclosure. FIG. 2 is a bottom view of an exploded diagram of the connector assembly according to the first embodiment of the present disclosure. FIG. 3 is a top view depicting that a first terminal and a second terminal welded on a flat cable. FIG. 4A is a schematic diagram depicting that a first body and a second body cladding a first terminal and a second terminal. FIG. 4B is a schematic diagram depicting a second surface of the first body and a fourth surface of the second body. FIG. 5 is a three-dimensional schematic diagram of the two sides of a third body. FIG. 6 is a three-dimensional schematic diagram depicting that the first body, the second body, and the flat cable after folding the flat cable in half with a flat cable folded part. FIG. 7 is a three-dimensional schematic diagram depicting that the third body cladding the first body, the second body, and the flat cable. FIG. 8 is a three-dimensional schematic diagram depicting a connector assembly of the first embodiment after a shell cladding the first body, the second body, the third body, and the flat cable.

Please refer to FIGS. 1, 2, 3, 4A, and 4B. Connector assembly 1 includes a connector and a flat cable 10. The connector includes a plurality of first terminals 20, a plurality of second terminals 30, a first body 40, a second body 50, a metal plate 60, a third body 70, and a shell 80. As depicted in FIGS. 1, 2, 3, 4A, and 4B, the flat cable 10 includes a first side 101, a second side 102, a third side 103, and a flat cable folded part 104. The first side 101 includes a plurality of first side electrical contacts 105, the second side 102 includes a plurality of second side electrical contacts 106, the third side 103 includes a plurality of third side electrical contacts 107, the first side electrical contacts 105 and the second side electrical contacts 106 are electrically connected to the third side electrical contacts 107. As depicted in FIG. 3, the first terminals 20 includes a plurality of first terminal conductive contact parts 201 and a plurality of first terminal contact parts 202, the first terminal conductive contact parts 201 are connected to the first side electrical contacts 105 of the first side 101. The second terminals 30 includes a plurality of second terminal conductive contact parts 301 and a plurality of second terminal contact parts 302. The second terminal conductive contact parts 301 are connected to the second side electrical contacts 106 of the second side 102. The electrically connecting way between the conductive contact parts 201, 301 and the electrical contacts 105, 106 of the flat cable 10 can be welding or thermal compression technology but not limited thereto. The electrically connecting way between the first terminal 20 and the second terminal 30 can be, like known technology, arranging a plurality of terminals to be made into strips, and then connecting the a plurality of terminals to the electrical contacts 105, 106 of the flat cable 10 with the aforementioned welding or thermal compression technology. The electrical contacts 105, 106 of the flat cable 10 can be welded or thermal compressed respectively, or the electrical contacts 105, 106 of the flat cable 10 can be welded or thermal compressed at the same time to further improve the operating efficiency, the present disclosure is not intended to limit.

After the electrically connecting between conductive contact parts 201, 301 and the electrical contacts 105, 106 of the flat cable 10 finished, please refer to FIGS. 4A and 4B. The first body 40 includes a first surface 401, a second surface 402, a plurality of first capacity slots 405 and a plurality of first through-holes 406. The first capacity slots 405 are located on the first surface 401, The first terminal contact parts 202 are respectively contained in the first capacity slots 405. The second body 50 includes a third surface 501, a fourth surface 502, a plurality of second capacity slots 505, and a plurality of second through-holes 506. The second capacity slots 505 are located on the third surface 501, the second terminal contact parts 302 are contained in the second capacity slots 505. It should be known that the first body 40 and the second body 50 are formed by plastic material with injection molding method. The injection molding procedures of the first body 40 and the second body 50 can be operated at the same time or be operated separately, the present disclosure is not limited thereto.

Please refer to FIGS. 1, 2, 3, 6, and 7. As depicted in FIG. 6, when folding the flat cable 10 in half along the flat cable folded part 104, the second surface 402 of the first body 40 and the fourth surface 502 of the second body 50 are opposite, which makes the metal plate 60 be clamped between the first body 40 and the second body 50.

After folding the flat cable 10 in half along the flat cable folded part 104, implementing a second injection molding to inject plastic material to form the third body 70. As depicted in FIG. 7, the third body 70 partly winds and fixes the first body 40, the second body 50 and the metal plate 60 clamped between them, but exposes the first terminal contact parts 202 and the second terminal contact parts 302. The formed third body 70 is as depicted in FIG. 7, wherein the connector assembly 1 without the shell 80 cladding is completed. Now the third body 70 partly clads and partly winds and fixes the first body 40 and the second body 50, exposes the first terminal contact parts 202 and the second terminal contact parts 302 (opposite to the first terminal contact parts 202, not shown) at a third front section 703, and provides a spacing between the first body 40 and the second body 50 at a third rear section 704 to protect the first terminal 20, the second terminal 30 and conductive contact parts 105, 106 connected to the flat cable 10 as depicted in FIG. 3. Then, as depicted in FIG. 8, after finishing the assembly of the shell 8, the connector assembly 1 of the present disclosure is completed.

Please refer to FIGS. 4A, 4B, and 5, the first body 40 further includes a first front section 403 and a first rear section 404. The first capacity slots 405 are located on the first surface 401 of the first front section 403. The first through-holes 406 are located on the second surface 402 of the first rear section 404. The first terminal 30 respectively passes through the first through-holes 406. The second body 50 further includes a second front section 503 and a second rear section 504. The second capacity slots 505 are located on the third surface 501 of the second front section 503. The second through-holes 506 are located on the fourth surface 502 of the second rear section 504. The second terminal 30 respectively passes through the second through-holes 506.

Please refer to FIGS. 4A and 4B, the first body 40 of the present disclosure further includes at least one first positioning column 409 and at least one first positioning hole 410. The at least one first positioning column 409 and the at least one first positioning hole 410 are disposed on the second surface 402. The second body 50 further includes at least one second positioning column 509 and at least one second positioning hole 510. The at least one second positioning column 509 and the at least one second positioning hole 510 are disposed on the fourth surface 502. After the flat cable 10 is folded in half along the flat cable folded part 104, the first positioning hole 410 can accommodate the second positioning column 509, the second positioning hole 510 can accommodate the first positioning column 409. As depicted in FIG. 4B, the first body 40 includes two first positioning columns 409 and two first positioning holes 410, the second body 50 includes two second positioning columns 509 and two second positioning holes 510, but the amount and positions are not limited. Please refer to FIGS. 2 and 4B, the metal plate 60 further includes at least one positioning through hole 601, configured to let the first positioning column 409 and the second positioning column 509 pass through after the flat cable 10 is folded in half along the flat cable folded part 104 and the second surface 402 of the first body 40 and the fourth surface 502 of the second body 50 are opposite.

Please refer to FIGS. 4B and 6, the first front section 403 of the first body 40 further includes a first section fixing fastener 408, and the second front section 503 of the second body 50 further includes a front section fixing buckle slot 508. After the flat cable 10 is folded in half along the flat cable folded part 104, the second surface 402 of the first body 40 and the fourth surface 502 of the second body 50 are opposite, and the metal plate 60 is clamped between the first body 40 and the second body 50, the first section fixing fastener 408 and the front section fixing buckle slot 508 are interlocked.

Please refer to FIGS. 4A, 5, and 6, the first body 40 further includes at least one first fixing slot way 407 disposed on the first surface 401. The second body 50 further includes at least one second fixing slot way 507 disposed on the third surface 501. The third body 70 further includes at least one fixing slot buckle strip 701. As depicted in FIG. 6, After the flat cable 10 is folded in half along the flat cable folded part 104, the second surface 402 of the first body 40 and the fourth surface 502 of the second body 50 are opposite, and the first section fixing fastener 408 and the front section fixing buckle slot 508 are interlocked, the third body 70 is formed, making the fixing slot buckle strips 701 buckled in the first fixing slot ways 407 and the second fixing slot ways 507, as depicted in FIGS. 4A and 7.

Please refer to FIGS. 4B and 6, the first body 40 further includes a rear section snapping piece 412 located at both sides of the first rear section 404, configured to snap the second body 50 after the second surface 402 of the first body 40 and the fourth surface 502 of the second body 50 are opposite. The first body 40 further includes a rear section embedding piece 411 located at both sides of the first rear section 404, configured to embed the third body 70 after the second surface 402 of the first body 40 and the fourth surface 502 of the second body 50 are opposite and the third body 70 is formed, as depicted in FIG. 7.

In addition, please refer to FIGS. 5 and 7. In the first embodiment of the present disclosure, the third body 70 further includes a front section fixing clasp 702 and a first section fixing fastener 705, configured to respectively clasp the first body 40 and the first body 50 after the third body 70 is formed.

Please refer to FIG. 8, the connector assembly 1 further includes a shell 8, cladding the first body 40, the second body 50, the third body 70 and the first side 101 and the second side 102 of the flat cable 10. The shell 8 is a metal shell. It should be noted that, as aforementioned, the first body 40, the second body 50 and the third body 70 are all formed by plastic material with injection molding method. In comparison with the existing connector, the connector assembly of the present disclosure can simplify the assembly steps and reduce the material cost. Because the terminals of the connector are directly connected to the flat cable, the high-frequency transmission of electronic signal only passes through one medium (the flat cable→the connector). Therefore, there is no need to use one more rigid printed circuit board to fix the connector, and the depletion and decay of the signal are drastically reduced.

Moreover, in the manufacturing process of the connector, welding or thermal compressing of the terminal conductive contact part and the electrical contact point of the flat cable are key steps for a low yield rate. The present disclosure operates these steps first and then operates follow-up production, which is different to the prior art. In the prior art, after the terminal and the main connector are welded to the rigid printed circuit board of the connector, the flat cable is welded to another rigid printed circuit board. If the welding step is after the assembly of the main connector, once the welding process fails, the cost of parts to be discarded is definitely higher than the present disclosure. Accordingly, this is one big improvement advantage of the present disclosure compared with the well-known art.

Figure 9:
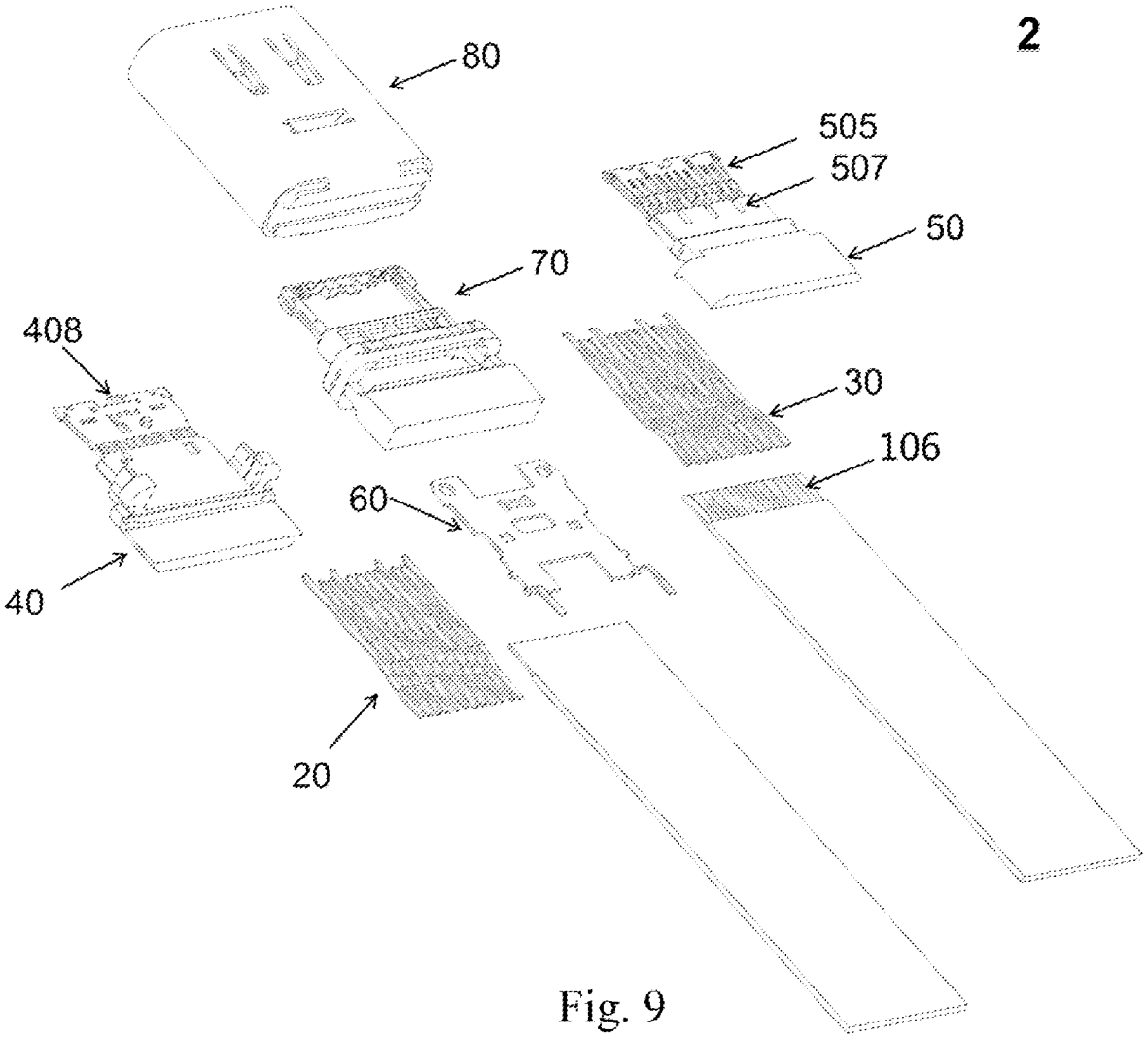
FIG. 9 is a top view of an exploded diagram of a connector assembly according to a second embodiment of the present disclosure.
Figure 10:
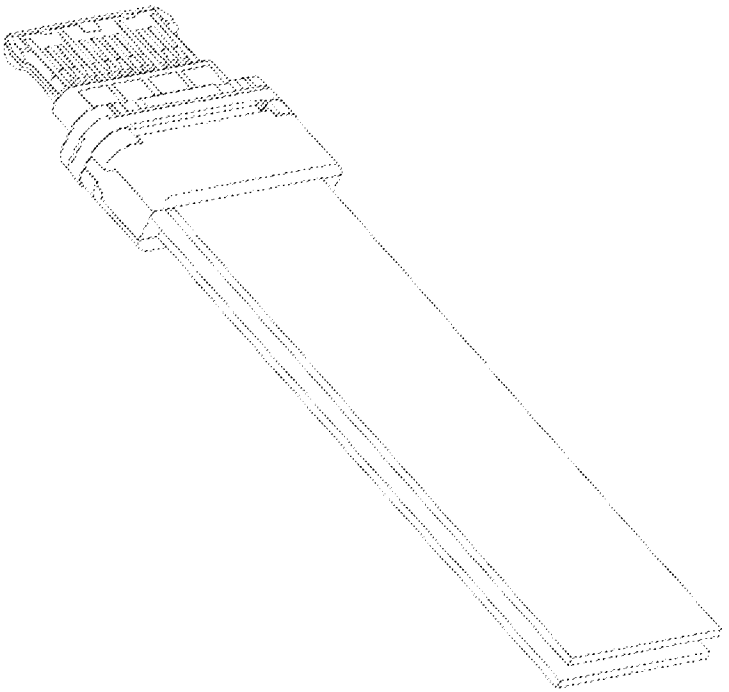
FIG. 10 is a three-dimensional schematic diagram depicting the connector assembly of the second embodiment before being cladded by a shell.

Please refer to FIGS. 9 and 10. FIG. 9 depicts a top view of an exploded diagram of a connector assembly according to a second embodiment of the present disclosure. FIG. 10 is a three-dimensional schematic diagram depicting the connector assembly of the second embodiment before being cladded by a shell.

The connector assembly 2 of the present disclosure includes a connector and two flat cables. The connector includes a plurality of first terminals 20, a plurality of second terminals 30, a first body 40, a second body 50, a metal plate 60, a third body 70, and a shell 80. As depicted in FIG. 9, each of the two flat cables includes a first side and a second side, the first side includes a plurality of first side electrical contacts, the second side includes a plurality of second side electrical contacts. Please refer to FIGS. 1-8 for other components, the amount of the first terminals 20 is a plurality of, wherein the first terminals 20 includes a plurality of first terminal conductive contact parts 201 and a plurality of first terminal contact parts 202. The first terminal conductive contact parts 201 are connected to the first side electrical contacts 105 of the first side 101. The amount of the second terminals 30 is a plurality of, wherein the second terminals 30 includes a plurality of second terminal conductive contact parts 301 and a plurality of second terminal contact parts 302. The second terminal conductive contact parts 301 are connected to the second side electrical contacts 106 of the second side 102. The difference between the connector assembly 2 of the second embodiment and the first embodiment is that the configurations of the flat cable are different. In the second embodiment, using two flat cables to replace the flat cable 10 including the first side 101, the second side 102, the third side 103 and the flat cable folded part 104 of the first embodiment.

Figure 11:
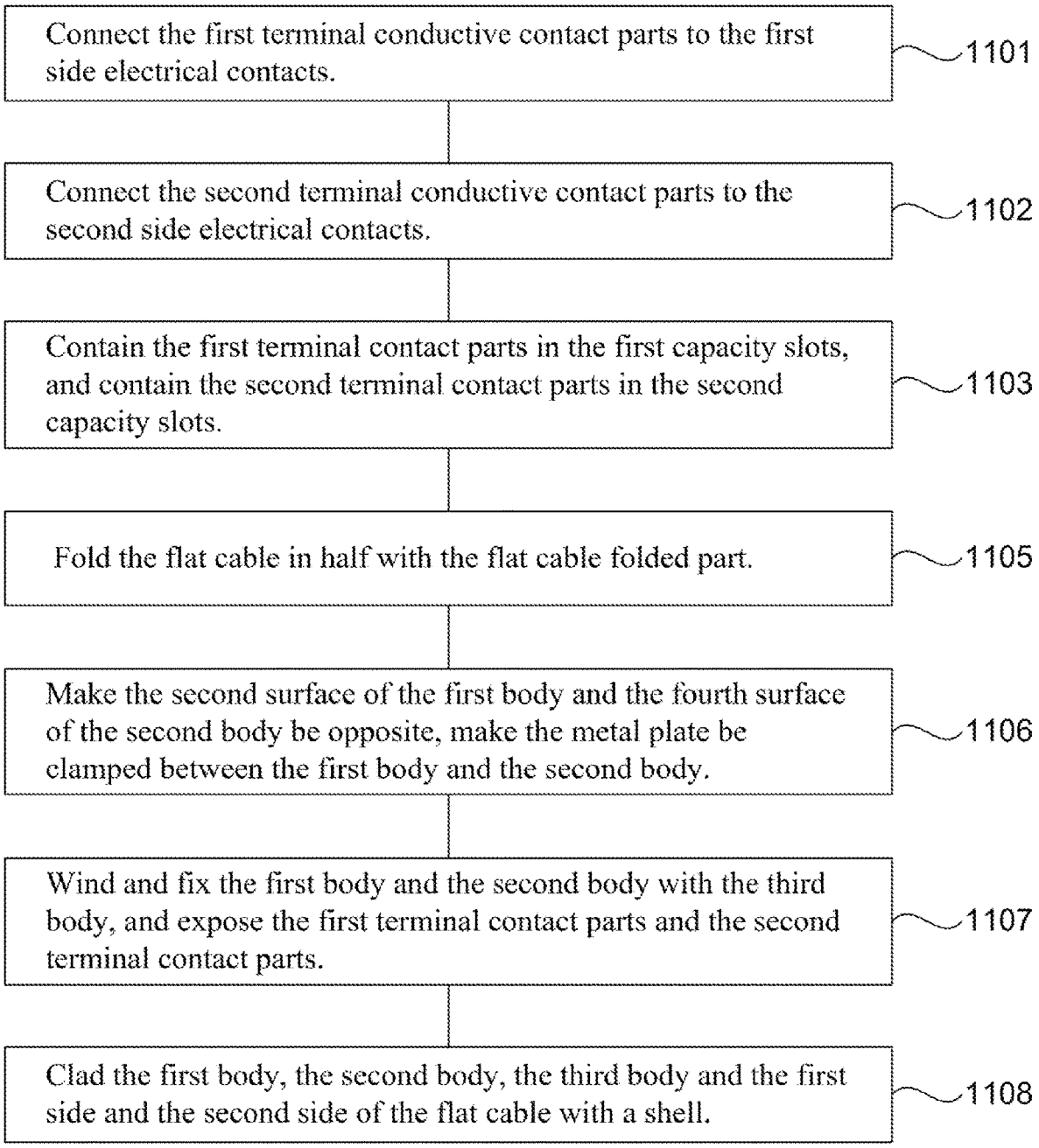
FIG. 11 illustrates a flowchart of a method of assembling the connector assembly according to the present disclosure.

Please refer to FIG. 11 illustrating a flowchart of a method of assembling the connector assembly according to the present disclosure, The method comprises blocks 1101-1108.

Block 1101: Connect the first terminal conductive contact parts 201 to the first side electrical contacts 105.

Block 1102: Connect the second terminal conductive contact parts 301 to the second side electrical contacts 106.

Block 1103: Contain the first terminal contact parts 202 in the first capacity slots 405, and contain the second terminal contact parts 302 in the second capacity slots 505.

Block 1106: Make the second surface of the first body 40 and the fourth surface of the second body 50 be opposite, make the metal plate 60 be clamped between the first body 40 and the second body 50.

Block 1107: Wind and fix the first body 40 and the second body 50 with the third body 70, and expose the first terminal contact parts 202 and the second terminal contact parts 302.

Block 1108: Clad the first body 40, the second body 50, the third body 70 and the first side and the second side of the flat cable 10 with a shell 80.

According to the first embodiment of the present disclosure, the flat cable 10 further comprises a third side comprising a plurality of third side electrical contacts 107, and a flat cable folded part 104. The method further comprises Block 1105: Fold the flat cable 10 in half with the flat cable folded part 104. The first side electrical contacts 105 and the second side electrical contacts 106 are electrically connected to the third side electrical contacts 107.

According to the second embodiment of the present disclosure shown in FIG. 9 and FIG. 10, the at least one flat cable 10 are two flat cables, one of the flat cables 10 comprises the first side comprising the plurality of first side electrical contacts 105, and the other of the flat cables 10 comprises the second side comprising the plurality of second side electrical contacts 106.

According to the present disclosure, containing the first terminal contact parts 202 and containing the second terminal contact parts 302 further comprise: forming the first body 40 and the second body 50 with injection molding, and clapping the first terminal 20 and the second terminal 30 with the first body 40 and the second body 50, respectively.

According to the present disclosure, the step of partly winding and fixing the first body 40 and the second body 50 with the third body 70 further comprises: forming the third body with injection molding, and partly clapping the first body 40 and the second body 50 clamping the metal plate 60 with the third body 70.

With the connector assembly of the present disclosure, the assembly is simple and manufacturing procedure is simplified. Accordingly, the connector assembly of the present disclosure can simplify the assembly steps and reduce the material cost. Because the terminals of the connector are directly connected to the flat cable, the high-frequency transmission of electronic signal only passes through one medium (the flat cable→the connector). Therefore, there is no need to use one more rigid printed circuit board to fix the connector, and the depletion and decay of the signal are drastically reduced. Moreover, in the manufacturing process of the connector, welding or thermal compressing of the terminal conductive contact part and the electrical contact point of the flat cable are key steps for a low yield rate. The present disclosure operates these steps first and then operates follow-up production, which is different to the prior art. In the prior art, after the terminal and the main connector are welded to the rigid printed circuit board of the connector, the flat cable is welded to another rigid printed circuit board. If the welding step is after the assembly of the main connector, once the welding process fails, the cost of parts to be discarded is definitely higher than the present disclosure. Accordingly, this is one big improvement advantage of the present disclosure compared with the well-known art.

The present disclosure has been described with a preferred embodiment thereof. The preferred embodiment is not intended to limit the present disclosure, and it is understood that many changes and modifications to the described embodiment can be carried out without departing from the scope and the spirit of the disclosure that is intended to be limited only by the appended claims.

What is claimed is:

1. A connector assembly, comprising:

a flat cable, comprising a first side, a second side, a third side and a flat cable folded part, wherein a plurality of first side electrical contacts at the first side comprises, a plurality of second side electrical contacts at the second side, a plurality of third side electrical contacts at the third side, the first side electrical contacts and the second side electrical contacts are electrically connected to the third side electrical contacts; and a connector, comprising:

a first terminal, comprising a plurality of first terminal conductive contact parts and a plurality of first terminal contact parts, the first terminal conductive contact parts are connected to the first side electrical contacts;

a second terminal, comprising a plurality of second terminal conductive contact parts and a plurality of second terminal contact parts, the second terminal conductive contact parts are connected to the second side electrical contacts;

a first body, comprising a first surface, a second surface, a plurality of first capacity slots and a plurality of first through-holes, wherein the first capacity slots are located on the first surface, the first terminal contact parts are respectively contained in the first capacity slots;

a second body, comprising a third surface, a fourth surface, a plurality of second capacity slots and a plurality of second through-holes, wherein the second capacity slots are located on the third surface, the second terminal contact parts are respectively contained in the second capacity slots;

a metal plate, folding the flat cable in half with the flat cable folded part, wherein the second surface of the first body and the fourth surface of the second body are opposite, making the metal plate be clamped between the first body and the second body; and a third body, partly winding and fixing the first body and the second body, exposing the first terminal contact parts and the second terminal contact parts.

2. The connector assembly of claim 1, wherein the connector further comprises a shell, cladding the first body, the second body, the third body and the first side and the second side of the flat cable.

3. The connector assembly of claim 1, wherein the first body further comprises a first front section and a first rear section, the first capacity slots are located on the first surface of the first front section, the first through-holes are located on the second surface of the first rear section, the first terminals respectively pass through the first through-holes.

4. The connector assembly of claim 1, wherein the second body further comprises a second front section and a second rear section, the second capacity slots are located on the third surface of the second front section, the second through-holes are located on the fourth surface of the second rear section, the second terminals respectively pass through the second through-holes.

5. The connector assembly of claim 1, wherein the first body further comprises at least one first positioning-hole and at least one first positioning column, disposed on the second surface; the second body further comprises at least one second positioning-hole and at least one second positioning column, disposed on the fourth surface; wherein the first positioning-hole is able to accommodate the second positioning column, the second positioning-hole is able to accommodate the first positioning column.

6. The connector assembly of claim 1, wherein the first body further comprises at least one first fixing slot way, disposed on the first surface, the third body further comprises at least one fixing slot buckle strip, the fixing slot buckle strip is buckled in the first fixing slot way.

7. The connector assembly of claim 1, wherein the second body further comprises at least one second fixing slot way, disposed on the third surface, the third body further comprises at least one fixing slot buckle strip, the fixing slot buckle strip is buckled in the second fixing slot way.

8. The connector assembly of claim 1, wherein the first body further comprises a first front section, the second body further comprises a second front section, the first front section further comprises a first section fixing fastener, the second front section further comprises a front section fixing buckle slot, the first section fixing fastener and the front section fixing buckle slot are interlocked.

9. The connector assembly of claim 1, wherein the first body further comprises a rear section embedding piece located at both sides of the first rear section, the rear section embedding piece is configured to embed the third body, the first body further comprises a rear section snapping piece located at both sides of the first rear section, the rear section snapping piece is configured to snap the second body.

10. The connector assembly of claim 1, wherein the third body further comprises a front section fixing clasp, configured to clasp the first body, the third body further comprises a first section fixing fastener, configured to fasten the second body.

11. The connector assembly of claim 1, wherein the metal plate further comprises at least one positioning through-hole, configured for the first positioning column and the second positioning column to pass through.

12. The connector assembly of claim 1, wherein the first body and the second body are respectively formed with injection molding, configured to respectively clap the first terminal and the second terminal.

13. The connector assembly of claim 1, wherein the third body is formed with injection molding, configured to partly clap the first body and the second body clamping the metal plate.

14. A connector assembly, comprising:

two flat cables, each comprising a first side and a second side, wherein the first side comprises a plurality of first side electrical contacts, the second side comprises a plurality of second side electrical contacts; and a connector, comprising:

a first terminal, comprises a plurality of first terminal conductive contact parts and a plurality of first terminal contact part comprises, the first terminal conductive contact parts are connected to the first side electrical contacts;

a second terminal, comprises a plurality of second terminal conductive contact parts and a plurality of second terminal contact parts, the second terminal conductive contact parts are connected to the second side electrical contacts;

a first body, comprises a first surface, a second surface, a plurality of first capacity slots and a plurality of first through-holes, wherein the first capacity slots are located on the first surface, the first terminal contact parts are respectively contained in the first capacity slots;

a second body, comprises a third surface, a fourth surface, a plurality of second capacity slots and a plurality of second through-holes, wherein the second capacity slots are located on the third surface, the second terminal contact parts are respectively contained in the second capacity slots;

a metal plate, wherein the second surface of the first body and the fourth surface of the second body are opposite, making the metal plate be clamped between the first body and the second body; and a third body, partly winding and fixing the first body and the second body, exposing the first terminal contact parts and the second terminal contact parts.

15. The connector assembly of claim 14, the connector further comprises a shell, clapping the first body, the second body, the third body and the first side and the second side of the flat cable.

16. The connector assembly of claim 14, wherein the first body further comprises a first front section and a first rear section, the first capacity slots are located on the first surface of the first front section, the first through-holes are located on the second surface of the first rear section, the first terminals respectively pass through the first through-holes.

17. The connector assembly of claim 14, wherein the second body further comprises a second front section and a second rear section, the second capacity slots are located on the third surface of the second front section, the second through-holes are located on the fourth surface of the second rear section, the second terminals respectively pass through the second through-holes.

18. The connector assembly of claim 14, wherein the first body further comprises at least one first positioning-hole and at least one first positioning column, disposed on the second surface; the second body further comprises at least one second positioning-hole and at least one second positioning column, disposed on the fourth surface; wherein the first positioning-hole is able to accommodate the second positioning column, the second positioning-hole is able to accommodate the first positioning column.

19. The connector assembly of claim 14, wherein the first body further comprises at least one first fixing slot way, disposed on the first surface, the third body further comprises at least one fixing slot buckle strip, the fixing slot buckle strip is buckled in the first fixing slot way.

20. The connector assembly of claim 14, wherein the second body further comprises at least one second fixing slot way, disposed on the third surface, the third body further comprises at least one fixing slot buckle strip, the fixing slot buckle strip is buckled in the second fixing slot way.

21. The connector assembly of claim 14, wherein the first body further comprises a first front section, the second body further comprises a second front section, the first front section further comprises a first section fixing fastener, the second front section further comprises a front section fixing buckle slot, the first section fixing fastener and the front section fixing buckle slot are interlocked.

22. The connector assembly of claim 14, wherein the first body further comprises a rear section embedding piece located on both sides of the first rear section, the rear section embedding piece is configured to embed the third body, the first body further comprises a rear section snapping piece located on both sides of the first rear section, the rear section snapping piece is configured to snap the second body.

23. The connector assembly of claim 14, wherein the third body further comprises a front section fixing clasp, configured to clasp the first body, the third body further comprises a first section fixing fastener, configured to fasten the first body.

24. The connector assembly of claim 14, wherein the metal plate further comprises at least one positioning through-hole, configured for the first positioning column and the second positioning column to pass through.

25. The connector assembly of claim 14, wherein the first body and the second body are respectively formed with injection molding, configured to respectively clap the first terminal and the second terminal.

26. The connector assembly of claim 14, wherein the third body is formed with injection molding, configured to partly clap the first body and the second body clamping the metal plate.

27. An assembly method for a connector assembly, wherein the connector assembly comprises at least one flat cable and a connector, the at least one flat cable comprises a first side comprising a plurality of first side electrical contacts, a second side comprising a plurality of second side electrical contacts, the connector comprises a first terminal comprising a plurality of first terminal conductive contact parts and a plurality of first terminal contact parts, a second terminal comprising a plurality of second terminal conductive contact parts and a plurality of second terminal contact parts, a first body comprising a first surface, a second surface, a plurality of first capacity slots located on the first surface and a plurality of first through-holes, a second body comprising a third surface, a fourth surface, a plurality of second capacity slots located on the third surface and a plurality of second through-holes, a metal plate and a third body, the assembly method comprises:

connecting the first terminal conductive contact parts to the first side electrical contacts;

connecting the second terminal conductive contact parts to the second side electrical contacts;

containing the first terminal contact parts in the first capacity slots, and containing the second terminal contact parts in the second capacity slots;

making the second surface of the first body and the fourth surface of the second body be opposite, making the metal plate be clamped between the first body and the second body; and partly winding and fixing the first body and the second body with the third body, exposing the first terminal contact parts and the second terminal contact parts.

28. The assembly method of claim 27, wherein the at least one flat cable are two flat cables, one of the flat cables comprises the first side comprising the plurality of first side electrical contacts, and the other of the flat cables comprises the second side comprising the plurality of second side electrical contacts.

29. The assembly method of claim 27, wherein the connector further comprises a shell, and after the step of partly winding and fixing the first body and the second body with the third body, the assembly method further comprises:

cladding the first body, the second body, the third body and the first side and the second side of the flat cable with the shell.

30. The assembly method of claim 27, the step of containing the first terminal contact parts and containing the second terminal contact parts further comprise:

forming the first body and the second body respectively with injection molding, and clapping the first terminal and the second terminal with the first body and the second body, respectively.

31. The connector assembly of claim 27, wherein the step of partly winding and fixing the first body and the second body with the third body further comprises:

forming the third body with injection molding; and partly clapping the first body and the second body clamping the metal plate with the third body.

32. The assembly method of claim 27, wherein the flat cable further comprises a third side comprising a plurality of third side electrical contacts, and a flat cable folded part, wherein the first side electrical contacts and the second side electrical contacts are electrically connected to the third side electrical contacts.

33. The assembly method of claim 28, wherein before the step of making the second surface of the first body and the fourth surface of the second body be opposite, the assembly method further comprising a step of folding the flat cable in half with the flat cable folded part.

* * * * *